US012320551B2

(12) United States Patent
Boyd et al.

(10) Patent No.: US 12,320,551 B2
(45) Date of Patent: Jun. 3, 2025

(54) VARIABLE CAPACITY FURNACE CONTROL

(71) Applicant: Johnson Controls Tyco IP Holdings LLP, Milwaukee, WI (US)

(72) Inventors: Andrew M. Boyd, Wichita, KS (US); Tom R. Tasker, Andover, KS (US); Rakesh Mathew, Wichita, KS (US)

(73) Assignee: JOHNSON CONTROLS LIGHT COMMERCIAL IP GMBH, Neuhausen am Rheinfall (CH)

( * ) Notice: Subject to any disclaimer, the term of this patent is extended or adjusted under 35 U.S.C. 154(b) by 573 days.

(21) Appl. No.: 17/752,525

(22) Filed: May 24, 2022

(65) Prior Publication Data

US 2022/0381480 A1 Dec. 1, 2022

Related U.S. Application Data

(60) Provisional application No. 63/195,625, filed on Jun. 1, 2021.

(51) Int. Cl.

| | |
|---|---|
| ***F24H 9/20*** | (2022.01) |
| ***F24H 3/00*** | (2022.01) |
| ***F24H 15/128*** | (2022.01) |
| ***F24H 15/208*** | (2022.01) |
| ***F24H 15/305*** | (2022.01) |

(52) U.S. Cl.

CPC ..... *F24H 9/2085* (2013.01); *F24H 3/006* (2013.01); *F24H 15/128* (2022.01); *F24H 15/208* (2022.01); *F24H 15/305* (2022.01)

(58) Field of Classification Search

CPC .... F24H 15/305; F24H 15/128; F24H 15/208; F24H 3/006

USPC ..... 700/276

See application file for complete search history.

(56) References Cited

U.S. PATENT DOCUMENTS

| | | | | |
|---|---|---|---|---|
| 10,753,623 | B2 * | 8/2020 | Harris | F23N 1/002 |
| 11,320,213 | B2 * | 5/2022 | Wilson | F24F 11/75 |
| 11,971,187 | B2 * | 4/2024 | Mathew | G05B 15/02 |
| 2010/0001087 | A1 * | 1/2010 | Gum | F23N 5/025 700/282 |

(Continued)

FOREIGN PATENT DOCUMENTS

WO WO-2020146817 A1 * 7/2020 ..... F23N 1/022

*Primary Examiner* — Ronald D Hartman, Jr.

(74) *Attorney, Agent, or Firm* — Fletcher Yoder, PC

(57) ABSTRACT

A variable capacity furnace includes a variable capacity fuel valve configured to supply a fuel to a burner, where the variable capacity fuel valve is configured to be controlled to a target setting over a range of settings to modulate an amount or flow rate of the fuel supplied to the burner. The variable capacity furnace also includes a control assembly having processing circuitry and memory circuitry. The memory circuitry includes instructions stored thereon that, when executed by the processing circuitry, cause the processing circuitry to execute a control algorithm to determine, based on whether an indoor temperature is progressing toward a set point over time and based on a temperature differential between the set point and the indoor temperature, a target setting of the variable capacity fuel valve. The instructions also cause the processing circuitry to control the variable capacity fuel valve to the target setting.

20 Claims, 4 Drawing Sheets

(56) References Cited

U.S. PATENT DOCUMENTS

2010/0179700 A1* 7/2010 Lorenz ..... F24H 9/2085
700/282
2020/0348087 A1* 11/2020 Wilson ..... F24F 11/75

* cited by examiner

300

VARIABLE USED IN CONTROL ALGORITHM

| | | 302 | 304 | 306 |
|---|---|---|---|---|
| | | NORMAL | COMFORT | EFFICIENCY |
| | | W1 | W2 | W2 |
| 308 | A | $A_{I}$ | $A_{II}$ | $A_{III}$ |
| 310 | B | $B_{I}$ | $B_{II}$ | $B_{III}$ |
| 312 | C | $C_{I}$ | $C_{II}$ | $C_{III}$ |
| 314 | D | $D_{I}$ | $D_{II}$ | $D_{III}$ |

FIG. 4

VARIABLE CAPACITY FURNACE CONTROL

CROSS-REFERENCE TO RELATED APPLICATIONS

This application claims priority from and the benefit of U.S. Provisional Application No. 63/195,625, entitled "VARIABLE CAPACITY FURNACE CONTROLS," filed Jun. 1, 2021, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments (e.g., enclosed spaces). For example, an HVAC system may include several heat exchangers, such as a heat exchanger configured to place an air flow in a heat exchange relationship with a refrigerant of a vapor compression circuit (e.g., evaporator, condenser), a heat exchanger configured to place an air flow in a heat exchange relationship with combustion products (e.g., a furnace), or both. In general, the heat exchange relationship(s) may cause a change in pressures and/or temperatures of the air flow, the refrigerant, the combustion products, or any combination thereof. The air flow may be directed toward the environment (e.g., enclosed space) to change a temperature of the environment. Control features may be employed to control the above-described components such that the temperature of the environment reaches a target temperature.

As described above, furnaces may place an air flow in a heat exchange relationship with combustion products, such that the air flow is heated by the combustion products. The combustion products may be generated by igniting a mixture of air and fuel, such as natural gas, in one or more burners of the furnace. The fuel may be provided by one or more fuel valves (e.g., gas valves) fluidly coupling the one or more burners to a fuel source.

Certain traditional embodiments may employ single or two stage furnaces that provide only one or two levels of heat output (e.g., via a limited number of gas valve settings), which limits a versatility and efficiency of the furnace. For example, a traditional single stage furnace may include a gas valve that is either opened to provide gas to the burner or closed to block gas from the burner, and a traditional two stage furnace may include a gas valve that is either fully opened to provide a first amount of gas to the burner, partially opened to provide a second amount of gas to the burner, or closed to block gas from the burner. Certain other traditional embodiments may employ a variable capacity furnace having a wider range of heat output levels (e.g., via a wider range of gas valve settings) than a single stage or two stage furnace. However, traditional embodiments employing a variable capacity furnace may include rudimentary gas valve control algorithms based on limited or rudimentary feedback and processing techniques, thereby rendering the variable capacity furnace less efficient and/or less versatile than would be possible with more robust gas valve control algorithms. Accordingly, it is now recognized that improved control algorithms for controlling gas valve settings in a variable capacity furnace are desired.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a variable capacity furnace includes a variable capacity fuel valve configured to supply a fuel to a burner, where the variable capacity fuel valve is configured to be controlled to a target setting over a range of settings to modulate an amount or flow rate of the fuel supplied to the burner. The variable capacity furnace also includes a control assembly having processing circuitry and memory circuitry. The memory circuitry includes instructions stored thereon that, when executed by the processing circuitry, cause the processing circuitry to execute a control algorithm to determine, based on whether an indoor temperature is progressing toward a set point over time and based on a temperature differential between the set point and the indoor temperature, a target setting of the variable capacity fuel valve. The instructions also cause the processing circuitry to control the variable capacity fuel valve to the target setting.

In an embodiment, a furnace includes a burner configured to generate combustion products from a fuel and an oxidant, a variable capacity fuel valve configured to be controlled to a target setting over a range of settings to modulate an amount or flow rate of the fuel supplied to the burner, and a controller. The controller is configured to determine, based on a first value indicative of whether an indoor temperature is progressing toward a set point over time and based on a second value indicative of a temperature differential between the set point and the indoor temperature, the target setting. The controller is also configured to control the variable capacity fuel valve to the target setting.

In an embodiment, one or more tangible, non-transitory, computer-readable media includes instructions stored thereon that, when executed by one or more processors, are configured to cause the one or more processors to receive a first input indicative of a temperature differential between a set point of a thermostat and an indoor temperature of an indoor space being heated by a variable capacity furnace, and receive a second input indicative of whether the indoor temperature is progressing toward the set point or away from the set point over time. The instructions are also configured to cause the one or more processors to determine, based on the first input and the second input, a target setting of a variable capacity fuel valve corresponding to the variable capacity furnace, and control the variable capacity fuel valve to the target setting.

BRIEF DESCRIPTION OF THE DRAWINGS

Various aspects of this disclosure may be better understood upon reading the following detailed description and upon reference to the drawings in which:

FIG. 4 is a table illustrating various variables utilized in the control algorithm of FIG. 3, in accordance with an aspect of the present disclosure.

DETAILED DESCRIPTION

Figure 1:
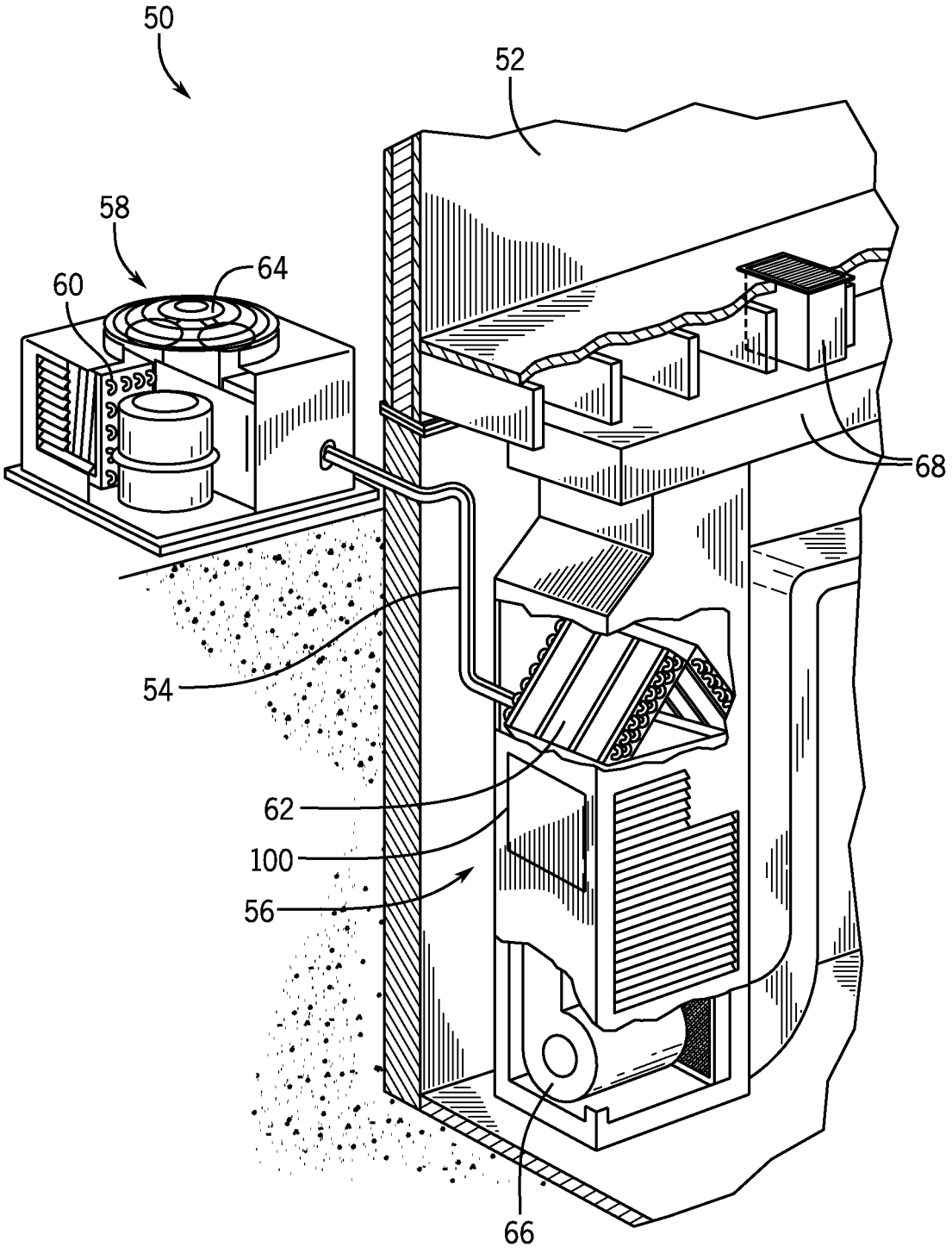
FIG. 1 is a cutaway perspective view of a split heating, ventilation, and/or air conditioning (HVAC) system, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to controlling a variable capacity fuel (e.g., gas) valve of a variable capacity furnace using a control algorithm (e.g., a proportional-integral-derivative [PID] control algorithm). For example, a controller of the furnace may receive a heating call (e.g., from a thermostat) based on a difference between a detected temperature of a space being heated by the furnace (e.g., an indoor temperature or indoor air temperature) and a set point (e.g., a target temperature entered to the thermostat). In response to the heating call, a controller (e.g., of a control assembly) associated with the furnace may execute the control algorithm to determine a setting of the variable capacity gas valve. For example, the variable capacity gas valve may be controlled in 1% increments between a minimum setting (e.g., 35% open) and a maximum setting (e.g., 100% open). Thus, the controller may execute the control algorithm to determine the setting of the variable capacity gas valve between the minimum setting and the maximum setting. As described in detail below, the control algorithm may include a number of terms that are combined and added to the minimum setting (e.g., 35%) of the variable capacity gas valve to generate the setting of the variable capacity gas valve. The controller may then control the variable capacity gas valve to the setting.

A first term of the PID control algorithm may be referred to in certain instances of the present disclosure as the temperature differential term. For example, the temperature differential term may include (1) a numerator being equal to a coefficient multiplier "A" times a quantity being equal to the set point minus the current indoor temperature minus a deadband setting; and (2) a denominator being equal to a temperature increment. The coefficient multiplier "A" is a constant percentage stored to a memory of the controller, although different values of the coefficient multiplier "A" may be used depending on an operating mode of the furnace. For example, the coefficient multiplier "A" may always be the same during a normal operating mode of the furnace, a different coefficient multiplier "A" may always be the same during a comfort operating mode of the furnace, and yet another different coefficient multiplier "A" may always be the same during an efficiency operating mode of the furnace. The temperature increment may be a constant value in degrees Fahrenheit, such as 0.1 degrees Fahrenheit. The deadband setting may be a constant value in degrees Fahrenheit, such as 0.2 degrees Fahrenheit, and will be described in more detail below. The set point may be a value entered to a thermostat as a target temperature of the space being heated by the furnace, as previously described, and the current indoor temperature may be detected by a sensor (e.g., a temperature sensor).

For purposes of illustration, as an example calculation of the first term (e.g., the temperature differential term) is provided below. Assume that the minimum setting of the variable capacity gas valve is 35%, the set point is 70 degrees Fahrenheit, the current indoor temperature is 69 degrees Fahrenheit, the furnace is in the normal operating mode and the normal operating mode includes a coefficient multiplier "A" of 4%, the temperature increment is 0.1 degrees Fahrenheit, and the deadband setting is 0.2 degrees Fahrenheit. Thus, the first term (e.g., the temperature differential term) of the control algorithms is calculated in this example as follows: (4%*(70 degrees F.−69 degrees F.− 0.2 degrees Fahrenheit))/0.1 degrees Fahrenheit=32%. In this example, the setting determined by the controller via the control algorithms is equal to the minimum setting (e.g., 35%) plus the first term (e.g., 32%) plus or minus a second term of the control algorithm described in detail below.

In certain operating conditions, the control algorithm may include a second term that is combined with the first term. The second term may be referred to in certain instances of the present disclosure as a "time-dependent term." The time-dependent term may be equal to a time-dependent constant "B" or a time-dependent constant "C." For example, the time-dependent constant "B" may be used for a period of time when the control algorithm determines that the indoor temperature is staying the same or moving away from the set point over time. The time-dependent constant "C" may be used for a period of time when the control algorithm determines that the indoor temperature is progressing (e.g., moving, transitioning) toward the set point. Of course, only one of "B" or "C" can exist at a given point in time. Further, neither "B" nor "C" is used when a difference between the indoor temperature and the set point is less than the deadband setting (e.g., 0.2 degrees Fahrenheit). In other words, if the difference between the indoor temperature and the set point is greater than the deadband setting, then one (and only one) of the time-dependent constants "B" or "C" is employed as outlined below.

If the controller determines (e.g., via the control algorithm) that the indoor temperature is not progressing toward the set point over time, the dependent constant "B" may be employed for a period of time. The time-dependent constant "B" is a percentage (e.g., 2%) that is combined with (e.g., added to) the first term (e.g., temperature differential term) of the control algorithm. For example, if the first term of the control algorithm is 32%, as noted in the example above, the time-dependent constant "B" is 2%, and the control algorithm determines that the time-dependent constant "B" applies, then the combination of the first term (e.g., temperature differential term) and the "B" based second term (e.g., time-dependent term) is 32% plus 2%=34%. The controller would then adjust the setting of the variable capacity gas valve to a percentage equal to the minimum setting (e.g., 35%) plus the combination of the first term and the second term (e.g., 34%), or to 69%. If the time-dependent constant "B" does not apply (e.g., if the time-dependent constant "C" applies), then the control algorithm omits the time-dependent constant "B" (e.g., a zero is included for the time-dependent constant "B"). It should be noted that the value of "B" for a given operating mode of the furnace may always be the same, assuming "B" applies. For example, a first value for "B" may always be used for the normal operating mode if "B" applies, a second value for "B" may always be used for the comfort operating mode if "B" applies, and a third value for "B" may always be used for the efficiency operating mode if "B" applies.

If the controller determines (e.g., via the control algorithm) that the indoor temperature is progressing toward the set point over time, the time-dependent constant "C" may be employed for a period of time. The time-dependent constant "C" corresponds to a percentage (e.g., 6%) that is combined with (e.g., subtracted from) the first term (e.g., temperature differential term) previously described. For example, if the first term of the control algorithm is 32%, as noted in the example above, the time-dependent constant "C" is 6%, and the control algorithm determines that the time-dependent constant "C" applies, then the combination of the first term (e.g., temperature differential term) and the second term (e.g., time-dependent term) is 32% minus 6%=26%. The controller would then adjust the setting of the variable capacity gas valve to a percentage equal to the minimum setting (e.g., 35%) plus the combination of the first term and the "C" based second term (e.g., 26%), or to 61%. If the time-dependent constant "C" does not apply (e.g., if the time-dependent constant "B" applies), then the control algorithm omits the time-dependent constant "C" (e.g., a zero is included for the time-dependent constant "C"). It should be noted that the value of "C" for a given operating mode of the furnace may always be the same, assuming "C" applies. For example, a first value for "C" may always be used for the normal operating mode if "C" applies, a second value for "C" may always be used for the comfort operating mode if "C" applies, and a third value for "C" may always be for the efficiency operating mode if "C" applies.

As noted above, the time-dependent constants "B" and "C" may not always be used. Indeed, neither "B" nor "C" is used when the difference between the indoor temperature and the set point is less than the deadband setting (e.g., 0.2 degrees Fahrenheit). Further, while the control algorithm repeatedly calculates the temperature differential term employing "A," the control algorithm may not always repeatedly calculate the second term (e.g., time-dependent term). Instead, the control algorithm may employ the previously determined "B" or "C" time-dependent constant for a period of time. The period of time during which the previously determined "B" or "C" may be employed is referred to in certain instances of the present disclosure as "Dmin." Dmin is equal to a constant "D" divided by a difference between the set point and the current indoor temperature, where Dmin is representative of a time interval (e.g., in minutes). Like "A," "B," and "C," the constant "D" utilized in the calculation of Dmin may always be the same for a given operating mode of the furnace. For example, a first value for "D" may always be used in the normal operating mode, a second value for "D" may always be used in the comfort operating mode, and a third value for "D" may always be used in the efficiency operating mode. After calculating Dmin (e.g., time interval), the control algorithm may continue to use the previously determined "B" or "C" until the time interval lapses. That is, the control algorithm may continue to calculate the first term (e.g., temperature differential term) and, during the Dmin time interval, may employ the previously determined time-dependent constant "B" or "C."

After the Dmin time interval has lapsed, the control algorithm may again determine whether the indoor temperature is progressing toward the set point to determine if time-dependent constant "B" or "C" applies. For example, if "B" is being used until Dmin lapses, after Dmin lapses, the control algorithm may determine that now "C" applies (i.e., the indoor temperature is progressing toward the set point over time), or that "B" continues to apply (i.e., the indoor temperature is staying the same or moving away from the set point over time), or that neither "B" nor "C" applies (i.e., the difference between the current indoor temperature and the set point is less than the deadband setting). In general, the Dmin time interval may increase when the difference between the set point and the current indoor temperature is reduced, since the difference between the set point and the current indoor temperature is in the denominator of the Dmin calculation. Further, the Dmin time interval may decrease when the difference between the set point and the current indoor temperature is increased, since the difference between the set point and the current indoor temperature is in the denominator of the Dmin calculation. However, in some embodiments, if the calculated Dmin is less than one minute (e.g., the current indoor temperature is relatively far from the set point), the control algorithm will set Dmin to one minute.

By employing the above-described control algorithm for a variable capacity furnace having a variable capacity gas valve, performance, versatility, and efficiency of the variable capacity furnace may be improved over traditional embodiments. These and other features will be described in detail below with reference to the drawings.

Turning now to the drawings, FIG. 1 illustrates an embodiment of a split heating, ventilation, and/or air conditioning (HVAC) system 50, referred to below as a "heating and cooling system." The heating and cooling system 50 may be employed in a residential context and configured to provide heated and cooled air to a residential structure. However, it should be noted that the heating and cooling system 50 of FIG. 1, or any aspect thereof (e.g., a furnace 100 of the heating and cooling system 50), may be used in a non-residential context (e.g., in a building).

In the illustrated embodiment, the heating and cooling system 50 is a split HVAC system. In general, a residence 52 (or other structure, such as a building) may include refrigerant conduits 54 that operatively couple an indoor unit 56 of the heating and cooling system 50 to an outdoor unit 58 of the heating and cooling system 50. The indoor unit 56 may be positioned in a utility room, an attic, a basement, and so forth. The outdoor unit 58 is typically situated adjacent to a side of the residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 1 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the heating and cooling system 50 may become operative to refrigerate additional air for circulation through the residence 52. When the temperature reaches the set point, or the set point minus a small amount, the heating and cooling system 50 may stop the refrigeration loop temporarily.

The heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace 100. For example, the indoor unit 56 may include the furnace 100 when the heating and cooling system 50 is not configured to operate as a heat pump. The furnace 100 may include a burner assembly and heat exchanger, among other components, inside the indoor unit 56. Fuel is provided to the burner assembly of the furnace 100 where it is mixed with air and combusted to form combustion products. The combustion products may pass through tubes or piping in a heat exchanger (e.g., different than the heat exchanger 62 described above), such that air directed by the blower or fan 66 passes over the tubes or pipes and extracts heat from the combustion products. The heated air may then be routed from the furnace 100 to the ductwork 68 for heating the residence 52. As will be appreciated in view of the description below with reference to later drawings, the furnace 100 may be a variable capacity furnace having gas valves that are controlled based on a heating call and control algorithm to deliver a desirable amount of fuel (e.g., natural gas) to the burner assembly, such that the combustion products provide a controlled amount of heat to the air passed through the heat exchanger of the furnace 100. The control algorithm(s) disclosed in detail below may provide for more efficient operation of the furnace 100 than otherwise possible with traditional control algorithms.

Figure 2:
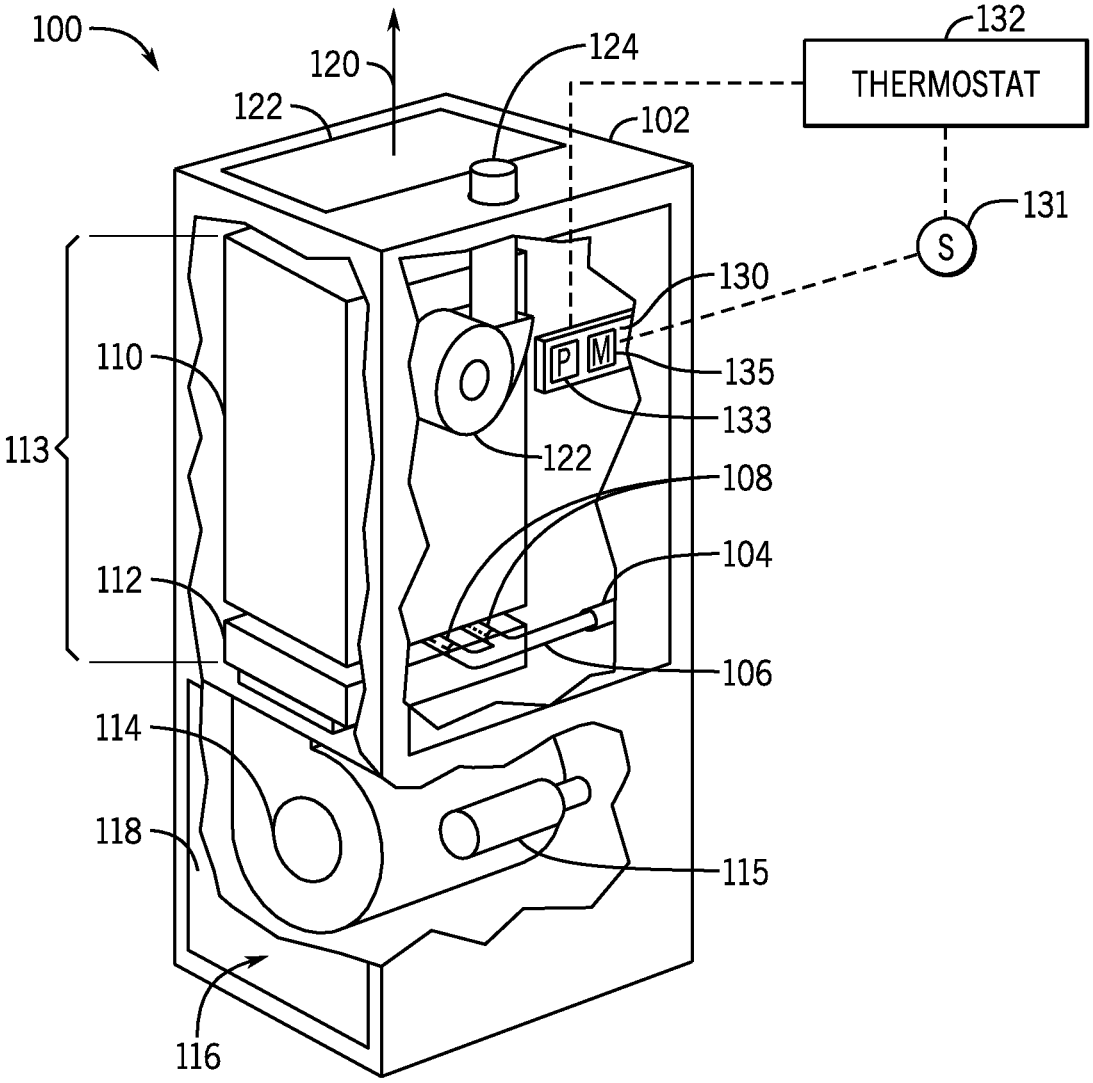
FIG. 2 is a perspective view of a furnace for use in the split HVAC system of FIG. 1, the furnace having a control assembly including a controller, a temperature sensor, and a thermostat, in accordance with an aspect of the present disclosure.

FIG. 2 is a perspective view of an embodiment of the furnace 100 of the heating and cooling system 50 of FIG. 1, the furnace 100 having a control assembly with a controller 130 coupled to a thermostat 132, the controller 130 being configured to control aspects of the furnace 100 based at least in part on a heating call (e.g., from the thermostat 132). For example, the controller 130 includes a processor 133 (e.g., processing circuitry) and a memory 135 (e.g., memory circuitry) storing instructions thereon that, when executed by the processor 133, causes the processor 133 and corresponding controller 130 to perform various functions described in detail below.

In the illustrated embodiment, the furnace 100 includes a housing 102 in which or on which a number of components of the furnace 100 are disposed. For example, the furnace 100 includes a fuel valve 104 (referred to in certain instances below as a gas valve) controllable to supply amounts of fuel (e.g., gas) through piping 106 to one or more burners 108 of the furnace 100. In some embodiments, multiple fuel valves 104 corresponding to each of the burners 108 may be employed. The fuel valve(s) 104 may be controllable to various settings that vary an amount of fuel (e.g., over a period of time, referred to in certain instances of the present disclosure as a flow rate) delivered to the burners 108. For example, the fuel valve(s) 104 may be adjusted by 1% increments between 35% open (e.g., minimum operating setting) and 100% open (e.g., maximum operating setting). Thus, the furnace 100 may be referred to as a "variable capacity furnace," which differs from furnaces that include single stage operation (e.g., with a valve that is either opened or closed) or two stage operation (e.g., with a valve that is either fully opened, partially opened at a single partially opened setting, or closed). The burners 108 are configured to combust a mixture of the fuel (e.g., gas) and oxidant (e.g., air) to generate combustion products routed through a primary heat exchanger 110 (e.g., primary heat exchange tubes or coils) and a secondary heat exchanger 112 (e.g., secondary heat exchange tubes or coils). The primary heat exchanger 112 and the secondary heat exchanger 112 may collectively be referred to as a heat exchange assembly 113. In some embodiments, the heat exchange assembly 113 may include only one heat exchanger.

In the illustrated embodiment, the primary heat exchanger 110 is fluidly coupled with the secondary heat exchanger 112 such that the combustion products are passed from the primary heat exchanger 110 to the secondary heat exchanger 112, or vice versa. Further, in some embodiments, the tubes or coils associated with the primary heat exchanger 110 may differ in size, shape, or material from the tubes or coils associated with the secondary heat exchanger 112. A fan 114 (e.g., circulating fan) of the furnace 100, driven by a motor 115 (e.g., electric blower motor), may draw a cold air flow 116 into the furnace 100, for example through a filter 118 of the furnace 100, such that the cold air flow 116 can be directed over the primary heat exchanger 110 and the secondary heat exchanger 112. The combustion products passing through the primary heat exchanger 110 and the secondary heat exchanger 112 may heat the cold air flow 116 to convert the cold air flow 116 to a heated air flow 120 that is passed from an outlet 122 of the furnace 100 to a duct associated with the residence or building in which the furnace 100 is employed. The duct may be a part of ductwork that directs the heated air flow 120 toward an environment (e.g., enclosed space) conditioned by the furnace 100 and/or other HVAC componentry.

The furnace 100 also includes a vent 124 (e.g., piping, such as polyvinyl chloride [PVC] piping or acrylonitrile butadiene styrene [ABS] plastic piping) fluidly coupled with the heat exchange assembly 113. For example, a draft inducing fan 126 may be coupled to, and between, the heat exchange assembly 113 and the vent 124. The draft inducing fan 126 may be configured to draw the combustion products through the tubes or coils of the heat exchange assembly 113 and pass the combustion products to the vent 124, which vents the combustion products to an external (e.g., ambient) environment outside of the building serviced by the furnace 100. In some embodiments, a setting of the draft inducing fan 126 may correspond to a setting of the gas valve 104.

The controller 130 of the furnace 100 may be employed to control operation of the various above-described components of the furnace 100. The illustrated controller 130 is disposed inside the housing 102 of the furnace 100, but it should be understood that the controller 130 may be disposed on the housing 102 (e.g., on an external surface of the housing 102), in another location separate from the furnace 100, or in a different location of the housing 102 than shown in the illustrated embodiment. Further, while the controller 130 is illustrated a single unit in FIG. 2, aspects of the controller 130 (e.g., processing circuitry 133, memory circuitry 135) may be divided between multiple discrete components. In accordance with present embodiments, the controller 130 may be configured to execute a control algorithm to determine a setting of the gas valve 104 (e.g., variable capacity gas valve). The control algorithm may be a PID control algorithm that analyzes various parameters or operating characteristics of the furnace 100 and space being heated by the furnace 100 (e.g., set point of the thermostat 132, indoor temperature, temperature differential between a previous indoor temperature and the current indoor temperature, deadband setting, operating mode of the furnace, etc.) to determine the setting of the gas valve 104. A sensor 131 (e.g., temperature sensor) may be communicatively coupled to the thermostat 132 and/or the controller 130 to provide data indicative of an indoor temperature of the space being heated by the furnace 100, where the indoor temperature is used by the controller 130 and/or the thermostat 132 to determine a heating call and/or other aspects of the control algorithm employed by the controller 130. These and other features are described in detail below with reference to FIG. 3.

Figure 3:
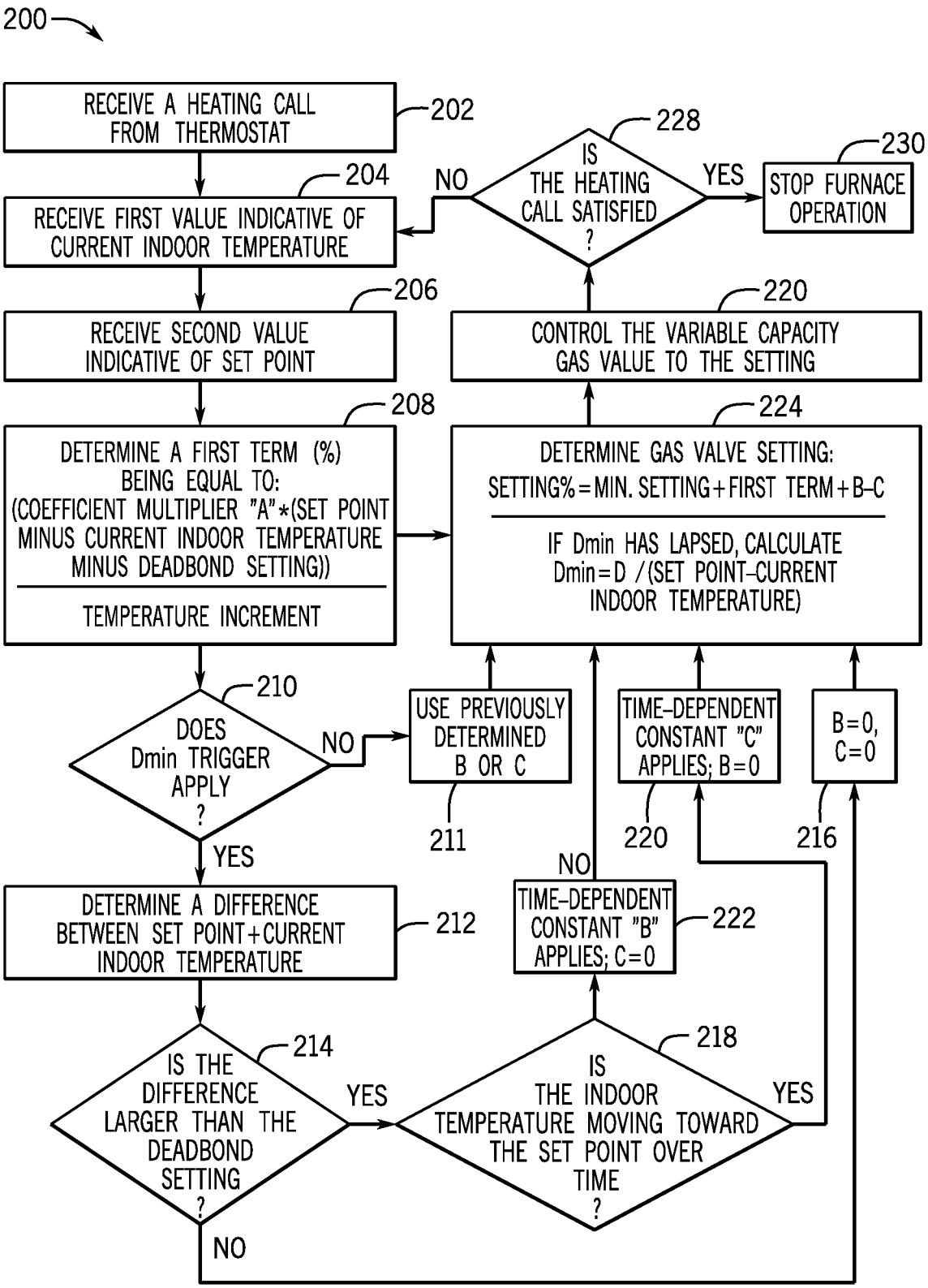
FIG. 3 is process flow diagram illustrating a method of controlling a variable capacity gas valve based on a control algorithm, such as a proportional-integral-derivative (PID) control algorithm, executed by the control assembly (or controller) of the furnace of FIG. 2, in accordance with an aspect of the present disclosure.

FIG. 3 is process flow diagram illustrating a method 200 of controlling a variable capacity gas valve based on a control algorithm (e.g., a proportional-integral-derivative [PID] algorithm) executed by the control assembly (or controller) of the furnace of FIG. 2. In the illustrated embodiment, the method 200 includes receiving (block 202) at the controller a heating call from a thermostat. For example, the thermostat may issue the heating call in response to an indoor temperature (e.g., detected by a temperature sensor) deviating from a set point (e.g., entered to an interface of the thermostat).

The method 200 also includes receiving (block 204) at the controller a first value indicative of an indoor temperature (e.g., current indoor temperature) of the space being heated by the furnace. For example, as previously described, a sensor (e.g., temperature sensor) may detect the indoor temperature. The sensor may be communicatively coupled to the controller and/or to the thermostat. That is, the controller may receive the first value indicative of the indoor temperature directly from the sensor, or from the sensor by way of the thermostat. The method 200 also includes receiving (block 206) a second value indicative of the set point. In some embodiments, the first value of the indoor temperature, the second value of the set point, or both may be received by the controller along with the heating call referenced in block 202.

The method 200 also includes determining (block 208), via the controller, a first term of the control algorithm, the first term being a percentage equal to a numerator divided by a denominator. The numerator is equal to a coefficient multiplier "A" multiplied by a quantity being equal to the set point minus the current indoor temperature minus a deadband setting. The coefficient multiplier "A" is a constant percentage stored to a memory of the controller, although different values of the coefficient multiplier "A" may be used depending on an operating mode of the furnace. For example, the coefficient multiplier "A" may always be the same during a normal operating mode of the furnace, a different coefficient multiplier "A" may always be the same during a comfort operating mode of the furnace, and yet another different coefficient multiplier "A" may always be the same during an efficiency operating mode of the furnace. The temperature increment may be a constant value in degrees Fahrenheit, such as 0.1 degrees Fahrenheit. The deadband setting may be a constant value in degrees Fahrenheit, such as 0.2 degrees Fahrenheit. The percentage calculated from the first term of the control algorithm in block 208 is utilized in a later step of the method 200 to determine the desired setting of the variable capacity gas valve.

After the first term is calculated, the method 200 may include determining whether a second term (e.g., time-dependent term) of the control algorithm should be determined and/or used. As will be appreciated in view of further description below, in certain operating conditions, a second term is determined and used to calculate the desired setting of the variable capacity gas valve. However, in certain other operating conditions, a previously determined second term is used. That is, while there is not a new determination of the second term, the previously determined second term is used. In still other operating conditions, a new second term is determined and used. In block 210 of the method 200, the controller may check to see if a Dmin value trigger applies. In general, Dmin, which may be calculated at a later step in the method 200, is indicative of a time interval during which a previously determined second term (e.g., time-dependent term) of the control algorithm is used. That is, if a Dmin time interval is calculated and the Dmin time interval has not lapsed, the previously determined second term of the control algorithm is used, whereas if the Dmin time interval has lapsed, the method 200 includes determining whether a new second term should be used. Indeed, the method 200 may include an iterative approach that makes adjustments to the setting of the variable capacity gas valve over time. That is, certain steps of the method 200 may be repeated over multiple iterations of the control algorithm. Accordingly, because the Dmin time interval may be calculated later in the method 200, in a first iteration (e.g., first pass) of the control algorithm, no Dmin time interval may exist. If no Dmin value exists (e.g., in the first iteration or pass of the control algorithm) or if the controller determines that a calculated Dmin time interval has lapsed, then the method 200 determines that a Dmin trigger applies. If a Dmin time interval has been calculated and the Dmin time interval has not lapsed, then no Dmin trigger applies. If no Dmin trigger applies, a previously calculated second term or time-dependent term (e.g., "B" or "C") is applied (e.g., block 211). Further discussion of Dmin and how it is used in the control algorithm will be provided below with reference to later steps in the method 200

When a Dmin trigger applies (i.e., when the Dmin time interval has lapsed or no Dmin yet exists), the method 200 continues to block 212. At block 212, the method 200 includes determining, via the controller, a difference between the set point and the current indoor temperature. At block 214, the method 200 includes determining if the difference calculated at block 212 is larger than the deadband setting. The deadband setting may be, for example, 0.2 degrees Fahrenheit. If the difference between the set point and the current indoor temperature is less than (i.e., not greater than) the deadband setting, the indoor temperature is sufficiently close to the set point and neither of the time-dependent constants "B" nor "C" is used (block 216). For example, both "B" and "C" may be set to zero (e.g., the control algorithm determines that no second term, or time-dependent term, of the control algorithm applies). This may be done to ensure that the method 200 does not result in a substantial overshoot of the set point (e.g., to ensure the indoor temperature does not substantially increase beyond the set point). If the difference between the indoor temperature and the set point is greater than the deadband setting, the indoor temperature is sufficiently different from the set point that one of the time-dependent constants "B" or "C" is used, and the method 200 continues to block 218.

At block 218, the method 200 includes determining if the indoor temperature is progressing toward the set point over time. For example, the controller may analyze the current indoor temperature and a previous (e.g., recent) indoor temperature to determine if the indoor temperature is progressing toward the set point over time. If the current indoor temperature is progressing toward the set point, time-based constant "C" is applied (block 220) and time-dependent constant "B" does not apply (e.g., "B" may be set to zero). If the current indoor temperature is not progressing toward the set point, time-based constant "B" is applied (block 222) and time-dependent constant "C" does not apply (e.g., "C" may be set to zero). As previously described, the time-dependent constant "B" may always be the same for a given operating mode of the furnace, assuming "B" applies. For example, a first value for "B" may always be used for the normal operating mode if "B" applies, a second value for "B" may always be used for the comfort operating mode if "B" applies, and a third value for "B" may always be used for the efficiency operating mode if "B" applies. Further, the time-dependent constant "C" may always be be the same for a given operating mode of the furnace, assuming "C" applies. For example, a first value for "C" may always be used for the normal operating mode if "C" applies, a second value for "C" may always be used for the comfort operating mode if "C" applies, and a third value for "C" may always be used for the efficiency operating mode if "C" applies.

At block 224, the method 200 includes determining (block 224) the gas valve setting. For example, as previously described, the gas valve setting includes the minimum setting (e.g., 35%) plus the first term (e.g., temperature differential term) calculated at block 208, combined with the second term (e.g., time-dependent term), if the second term applies in accordance with the description above. "Combined with" may include adding the second term or subtracting the second term, depending on whether the second term corresponds to the time-dependent constant "B" or the time-dependent constant "C." The second term utilized in block 224 may come from block 211, block 220, or block 222, depending on previous ones of the method 200 steps described above. Further, as previously described, in certain operating conditions (e.g., where the difference between the current indoor temperature and the set point is less than the deadband setting) no second term is used (e.g., block 216).

Block 224 also includes calculating a Dmin value if the Dmin trigger from block 210 applied (e.g., if no Dmin time interval previously existed, such as on the first iteration of the control algorithm following the heating call from block 220, or if a previously calculated Dmin time interval has lapsed). Dmin is equal to a constant "D" divided by a difference between the set point and the current indoor temperature, where the Dmin value corresponds to a number of minutes during which the time-dependent constant "B" or "C" is used. The constant "D" may always be the same for a given operating mode of the furnace. For example, a first value for "D" may always be used for the normal operating mode, a second value for "D" may always be used for the comfort operating mode, and a third value for "D" may always be used for the efficiency operating mode. As the control algorithm loops through multiple iterations, the block 210 may be encountered multiple times. As previously described, the Dmin trigger at block 210 applies if the Dmin time interval calculated at block 224 has lapsed or no Dmin time interval exists.

After block 226, the method 200 includes controlling the variable capacity fuel valve to the setting calculated at block 224. For example, assume that the minimum setting of the variable capacity gas valve is 35%, the first term calculated at block 208 is 32%, "B" applies from block 222, and "B" is equal to 2%. Based on this example, the variable capacity gas valve would be set by the controller at block 226, based on the calculation at block 224, to: 35% plus 32% plus 2%=69%.

Finally, the method 200 includes determining (block 228) whether the heating call has been satisfied. If the heating call has been satisfied, the method 200 includes stopping (block 230), via the controller, operation of the furnace. If the heating call has not been satisfied, the method 200 proceeds from block 228 back to block 204.

FIG. 4 is a table 300 illustrating various variables (e.g., coefficients and multipliers) utilized in the control algorithm of FIG. 3, in accordance with an aspect of the present disclosure. For example, as previously described, the control algorithm may be employed during a normal operating mode 302 of the furnace, a comfort operating mode 304 of the furnace, and an efficiency operating mode 306 of the furnace. The variables include the coefficient multiplier "A" 308, the time-dependent constant "B" 310, the time-dependent constant "C" 312, and the constant "D" 314 (e.g., utilized to calculate Dmin). The coefficient multiplier "A" 308 may vary based on the furnace being operated in the normal operating mode 302 (i.e., $A_i$), the comfort operating mode 304 (i.e., $A_{ii}$), or the efficiency operating mode (i.e., $A_{iii}$). In general, $A_{ii}$ associated with the comfort operating mode may be larger than $A_i$ and $A_{iii}$. Further, the time-dependent constant "B" 310 may vary based on the furnace being operated in the normal operating mode 302 (i.e., $B_i$), the comfort operating mode 304 (i.e., $B_{ii}$), or the efficiency operating mode (i.e., $B_{iii}$). In general, associated with the comfort operating mode and $B_{ii}$ associated with the efficiency operating mode may be larger than $B_i$. Further still, the time-dependent constant "C" 312 may vary based on the furnace being operated in the normal operating mode 302 (i.e., $C_i$), the comfort operating mode 304 (i.e., $C_{ii}$), or the efficiency operating mode (i.e., $C_{iii}$). Further still, the constant "D" 314 may vary based on the furnace being operated in the normal operating mode 302 (i.e., $D_i$), the comfort operating mode 304 (i.e., $D_{ii}$), or the efficiency operating mode (i.e., $D_{iii}$). In general, $D_i$ may be larger than $D_{ii}$ and $D_{iii}$.

The above-described features may cause the furnace, in the comfort operating mode, to heat a space more quickly than in the normal operating mode and the efficiency operating mode (i.e., to reach the set point more quickly in the comfort operating mode). Further, the above-described features may cause the furnace, in the efficiency operating mode, to heat the space more efficiently (e.g., utilizing less fuel or energy) than in the normal operating mode and the comfort operating mode.

The present disclosure may provide one or more technical effects useful in the operation of an HVAC system. For example, by employing the above-described PID algorithm for a variable capacity furnace having a variable capacity gas valve, performance, versatility, and efficiency of the variable capacity furnace may be improved over traditional embodiments.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A variable capacity furnace, comprising:

a variable capacity fuel valve configured to supply a fuel to a burner, wherein the variable capacity fuel valve is configured to be controlled to a target setting over a range of settings to modulate an amount or flow rate of the fuel supplied to the burner; and a control assembly having processing circuitry and memory circuitry storing instructions thereon that, when executed by the processing circuitry, cause the processing circuitry to:

execute a control algorithm to determine, based on whether an indoor temperature is progressing toward a set point over time and based on a temperature differential between the set point and the indoor temperature, the target setting of the variable capacity fuel valve; and control the variable capacity fuel valve to the target setting.

2. The variable capacity furnace of claim 1, wherein the instructions cause the processing circuitry to execute the control algorithm by causing the processing circuitry to:

determine a first quantity being equal to the temperature differential minus a deadband setting;

determine a second quantity being equal to the first quantity multiplied by a coefficient multiplier; and determine, based on whether the indoor temperature is progressing toward the set point over time and based on the second quantity, the target setting of the variable capacity fuel valve.

3. The variable capacity furnace of claim 2, wherein the instructions cause the processing circuitry to execute the control algorithm by causing the processing circuitry to:

determine a third quantity being equal to the second quantity divided by a temperature increment; and determine, based on whether the indoor temperature is progressing toward the set point over time and based on the third quantity, the target setting of the variable capacity fuel valve.

4. The variable capacity furnace of claim 3, wherein the temperature increment is 0.1 degrees Fahrenheit.

5. The variable capacity furnace of claim 2, wherein the instructions cause the processing circuitry to execute the control algorithm by causing the processing circuitry to select the coefficient multiplier from a plurality of coefficient multipliers corresponding to a plurality of operating modes of the variable capacity furnace.

6. The variable capacity furnace of claim 5, wherein the plurality of operating modes of the variable capacity furnace include a normal operating mode, a comfort operating mode configured to align the indoor temperature with the set point more quickly than the normal operating mode, and an efficiency operating mode configured to align the indoor temperature with the set point via a reduced energy consumption relative to the normal operating mode.

7. The variable capacity furnace of claim 1, comprising a sensor configured to detect the indoor temperature, wherein the control assembly is configured to receive data indicative of the indoor temperature from the sensor.

8. The variable capacity furnace of claim 1, wherein the instructions cause the processing circuitry to execute the control algorithm by causing the processing circuitry to:

determine whether the temperature differential is greater than a deadband setting;

in response to determining that the temperature differential is greater than the deadband setting, determine a time-dependent constant based on whether the indoor temperature is progressing toward the set point over time; and determine, based on the time-dependent constant and the temperature differential, the target setting of the variable capacity fuel valve.

9. The variable capacity furnace of claim 8, wherein the instructions cause the processing circuitry to execute the control algorithm by causing the processing circuitry to:

employ, in response to determining that the indoor temperature is progressing toward the set point over time, a first value as the time-dependent constant; and employ, in response to determining that the indoor temperature is not progressing toward the set point over time, a second value as the time-dependent constant, the second value being different than the first value.

10. The variable capacity furnace of claim 9, wherein the instructions cause the processing circuitry to execute the control algorithm by causing the processing circuitry to:

determine a wait time being equal to a constant divided by a quantity, the quantity being equal to the set point minus the indoor temperature;

employ, in response to determining that the indoor temperature is progressing toward the set point over time, the first value as the time-dependent constant for a duration of the wait time; and employ, in response to determining that the indoor temperature is not progressing toward the set point over time, the second value as the time-dependent constant for the duration of the wait time, the second value being different than the first value.

11. A furnace, comprising:

a burner configured to generate combustion products from a fuel and an oxidant;

a fuel valve configured to be controlled to a target setting over a range of settings to modulate an amount or flow rate of the fuel supplied to the burner; and a controller configured to:

determine, based on a first value indicative of whether an indoor temperature is progressing toward a set point over time and based on a second value indicative of a temperature differential between the set point and the indoor temperature, the target setting; and control the fuel valve to the target setting.

12. The furnace of claim 11, wherein the controller is configured to:

determine a first quantity being equal to the second value minus a deadband setting;

determine a second quantity being equal to the first quantity multiplied by a coefficient multiplier;

determine a third quantity being equal to the second quantity divided by a temperature increment; and determine, based on the first value and based on the third quantity, the target setting of the fuel valve.

13. The furnace of claim 12, wherein the controller is configured to select the coefficient multiplier from a plurality of coefficient multipliers corresponding to a plurality of operating modes of the furnace.

14. The furnace of claim 13, wherein the plurality of operating modes of the furnace include a normal operating mode, a comfort operating mode configured to align the indoor temperature with the set point more quickly than the normal operating mode, and an efficiency operating mode configured to align the indoor temperature with the set point via a reduced energy consumption relative to the normal operating mode.

15. The furnace of claim 11, wherein the controller is configured to:

determine whether the temperature differential is greater than a deadband setting;

in response to determining that the temperature differential is greater than the deadband setting, determine a time-dependent constant based on the second value; and determine, based on the time-dependent constant and the first value, the target setting of the fuel valve.

16. One or more tangible, non-transitory, computer-readable media storing instructions thereon that, when executed by one or more processors, are configured to cause the one or more processors to:

receive a first input indicative of a temperature differential between a set point of a thermostat and an indoor temperature of an indoor space being heated by a variable capacity furnace;

receive a second input indicative of whether the indoor temperature is progressing toward the set point or away from the set point over time;

determine, based on the first input and the second input, a target setting of a variable capacity fuel valve configured to modulate an amount or flow rate of a fuel supplied to a burner assembly of the variable capacity furnace; and control the variable capacity fuel valve to the target setting.

17. The one or more tangible, non-transitory, computer-readable media of claim 16, wherein the instructions, when executed by the one or more processors, are configured to cause the one or more processors to:

determine, based on the first input, a first quantity being equal to the temperature differential minus a deadband setting;

determine a second quantity being equal to the first quantity multiplied by a coefficient multiplier; and determine, based on the second quantity and the second input, the target setting of the variable capacity fuel valve.

18. The one or more tangible, non-transitory, computer-readable media of claim 17, wherein the instructions, when executed by the one or more processors, are configured to cause the one or more processors to:

determine a third quantity being equal to the second quantity divided by a pre-defined temperature increment; and determine, based on the third quantity and the second input, the target setting of the variable capacity fuel valve.

19. The one or more tangible, non-transitory, computer-readable media of claim 17, wherein the instructions, when executed by the one or more processors, are configured to cause the one or more processors to select the coefficient multiplier from a plurality of coefficient multipliers corresponding to a plurality of operating modes of the variable capacity furnace, the plurality of operating modes comprising a normal operating mode, a comfort operating mode configured to align the indoor temperature with the set point more quickly than the normal operating mode, and an efficiency operating mode configured to align the indoor temperature with the set point via a reduced energy consumption relative to the normal operating mode.

20. The one or more tangible, non-transitory, computer-readable media of claim 16, wherein the instructions, when executed by the one or more processors, are configured to cause the one or more processors to:

determine whether the temperature differential is greater than a deadband setting;

in response to determining that the temperature differential is greater than the deadband setting, determine a time-dependent constant based on the second input; and determine, based on the time-dependent constant and the first input, the target setting of the variable capacity fuel valve.

* * * * *